US011927197B2

(12) United States Patent
Anderson et al.

(10) Patent No.: US 11,927,197 B2
(45) Date of Patent: Mar. 12, 2024

(54) BEARING COOLER FOR A CENTRIFUGAL FAN

(71) Applicant: Hewlett-Packard Development Company, L.P., Spring, TX (US)

(72) Inventors: Ronald Robert Anderson, Corvallis, OR (US); Gregory Charles Reed, Corvallis, OR (US); Richard Walter Riper, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/795,973

(22) PCT Filed: Mar. 6, 2020

(86) PCT No.: PCT/US2020/021339

§ 371 (c)(1),
(2) Date: Jul. 28, 2022

(87) PCT Pub. No.: WO2021/177969

PCT Pub. Date: Sep. 10, 2021

(65) Prior Publication Data

US 2023/0049020 A1 Feb. 16, 2023

(51) Int. Cl.

| | |
|---|---|
| ***F04D 29/58*** | (2006.01) |
| ***F04D 29/056*** | (2006.01) |
| ***F04D 29/42*** | (2006.01) |

(52) U.S. Cl.

CPC ..... *F04D 29/582* (2013.01); *F04D 29/056* (2013.01); *F04D 29/4226* (2013.01)

(58) Field of Classification Search

CPC ..... F04D 25/02; F04D 25/08; F04D 29/582; F04D 29/047; F04D 29/056; F04D 29/057; F04D 29/4226; F16C 37/00; F16C 37/007

See application file for complete search history.

(56) References Cited

U.S. PATENT DOCUMENTS

| | | | | |
|---|---|---|---|---|
| 2,966,297 | A * | 12/1960 | Sperling | F04D 29/424 415/97 |
| 3,680,978 | A * | 8/1972 | Mercer | F04D 29/263 384/317 |
| 3,746,464 | A * | 7/1973 | Goettl | F04D 29/059 416/178 |
| 3,804,474 | A * | 4/1974 | Ettles | F16C 33/10 384/399 |
| 5,971,010 | A * | 10/1999 | Kallberg | F01D 5/084 137/340 |
| 6,951,449 | B2 | 10/2005 | Huang et al. | |
| 8,419,364 | B2 | 4/2013 | Bouchard | |
| 8,540,497 | B2 | 9/2013 | Chang | |
| 9,127,688 | B2 | 9/2015 | Chou | |
| 2007/0037109 | A1 | 2/2007 | Lange | |

FOREIGN PATENT DOCUMENTS

| | | | |
|---|---|---|---|
| CN | 2649824 | Y | 10/2004 |
| CN | 205136076 | U | 4/2016 |
| JP | 2009-216030 | A | 9/2009 |
| RU | 2166671 | C1 | 5/2001 |

* cited by examiner

*Primary Examiner* — Kenneth J Hansen

(57) ABSTRACT

In one example, a centrifugal fan includes a bearing, a shaft rotatably supported by the bearing, fan blades operatively connected to and rotatable with the shaft to take in air axially and to exhaust air radially, and a groove in the shaft extending axially along an outer surface of the shaft through the bearing.

12 Claims, 8 Drawing Sheets

BEARING COOLER FOR A CENTRIFUGAL FAN

BACKGROUND

In many high speed inkjet printing systems hot air is used to dry wet ink on the printed substrate. High volume fans blow hot air over the printed substrate to dry wet ink.

DRAWINGS

Figure 1:
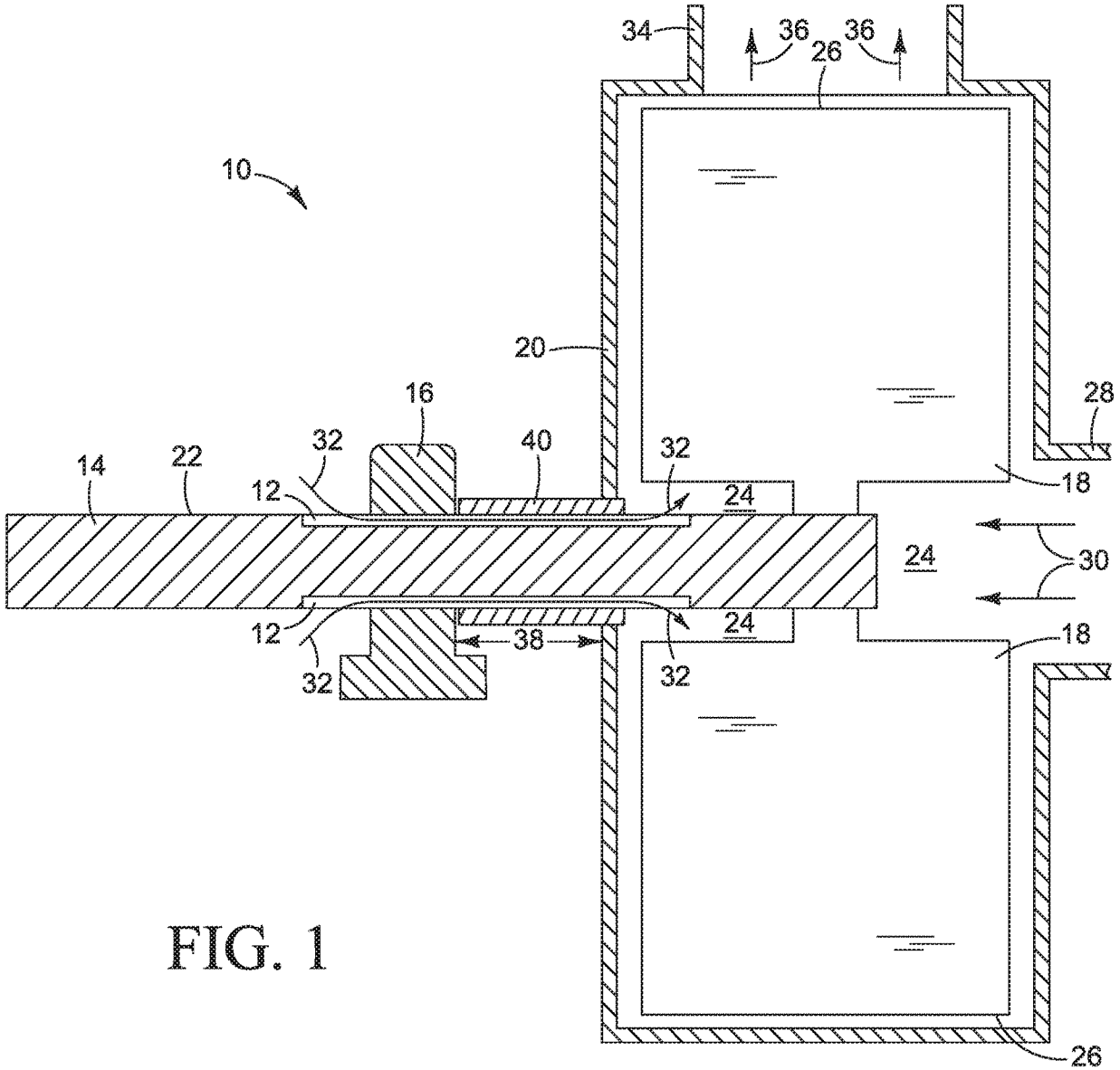

FIG. 1 illustrates one example of a centrifugal fan implementing bearing cooler grooves.

Figure 2:
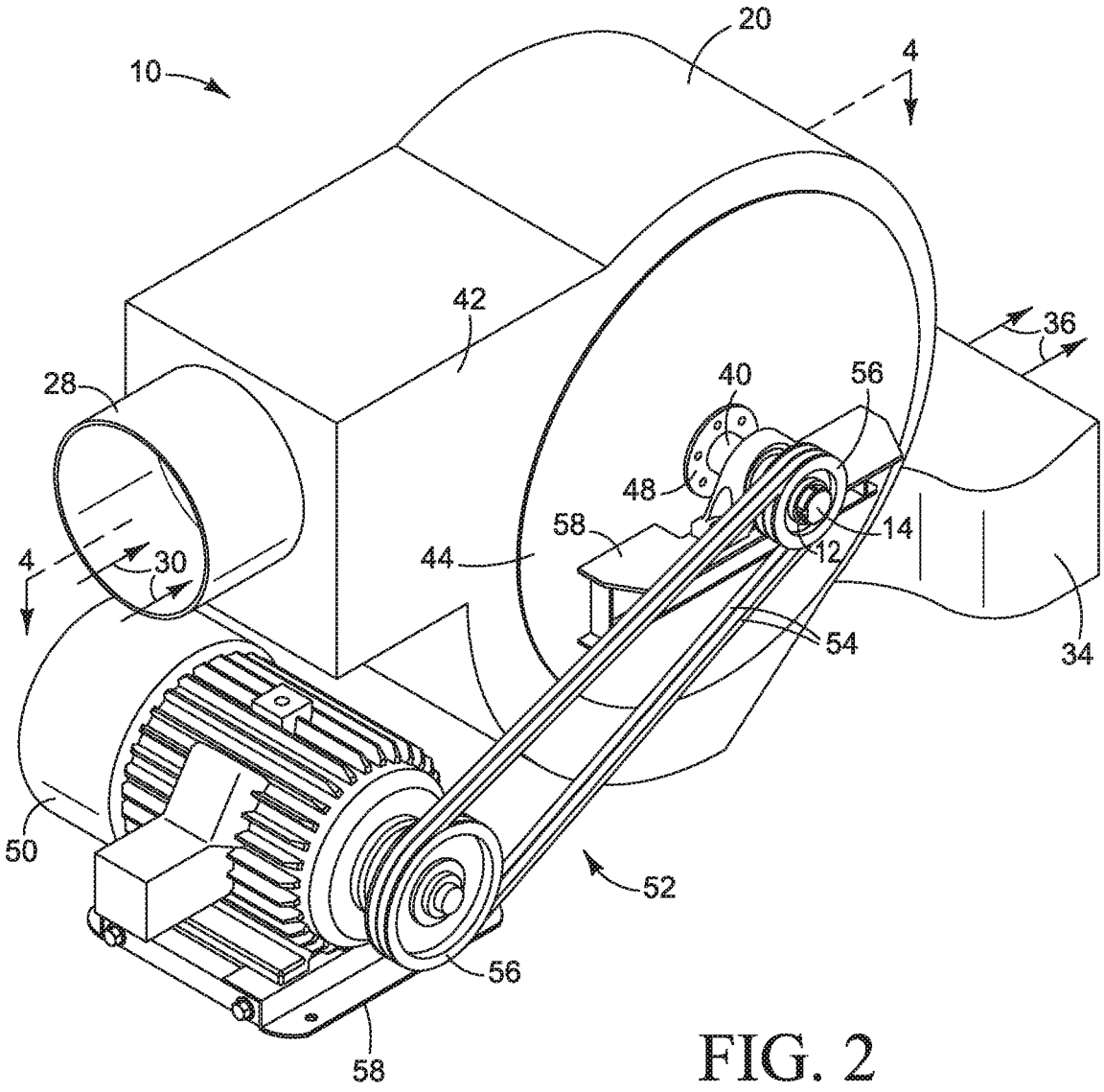
Figure 3:
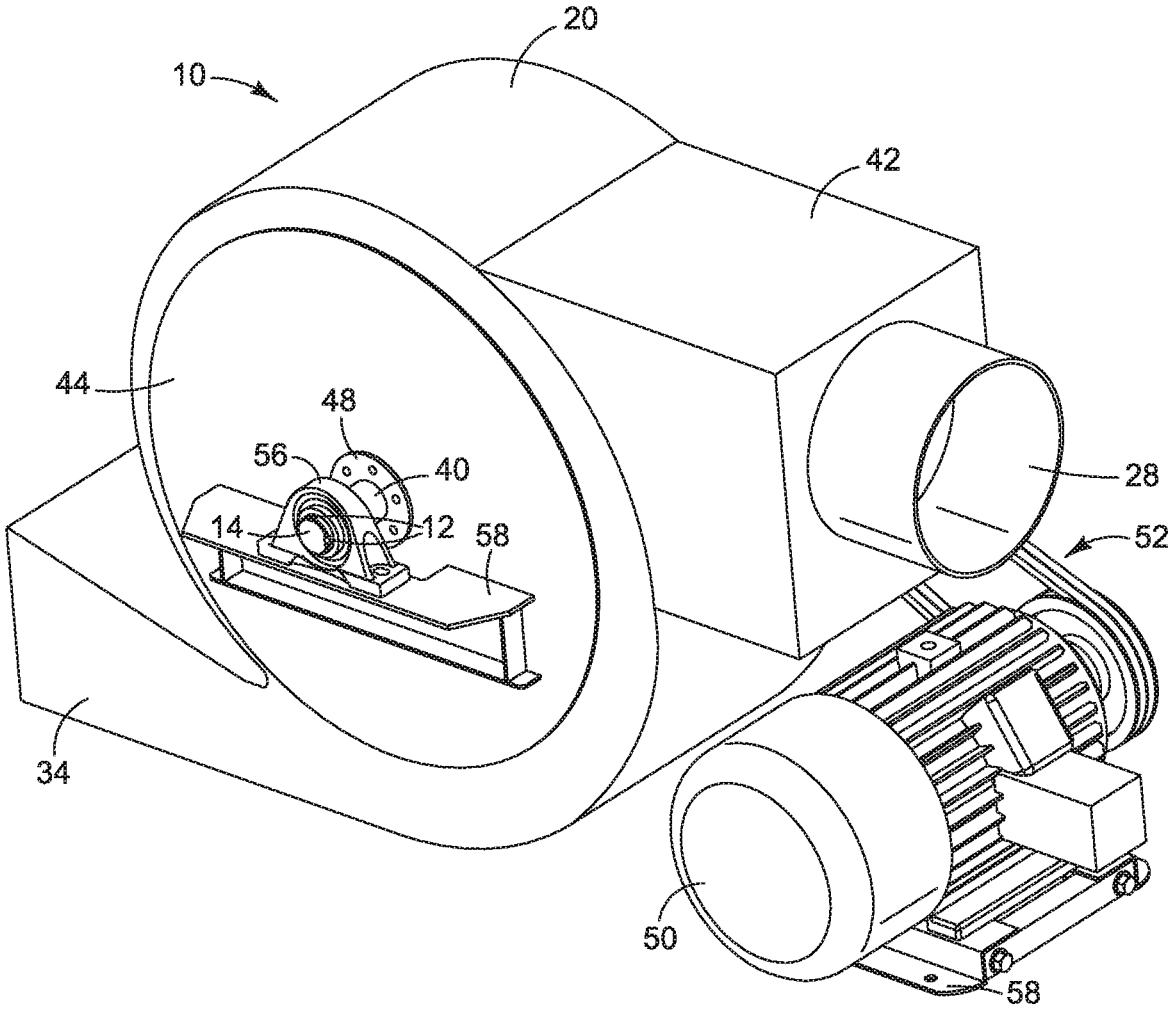
Figure 4:
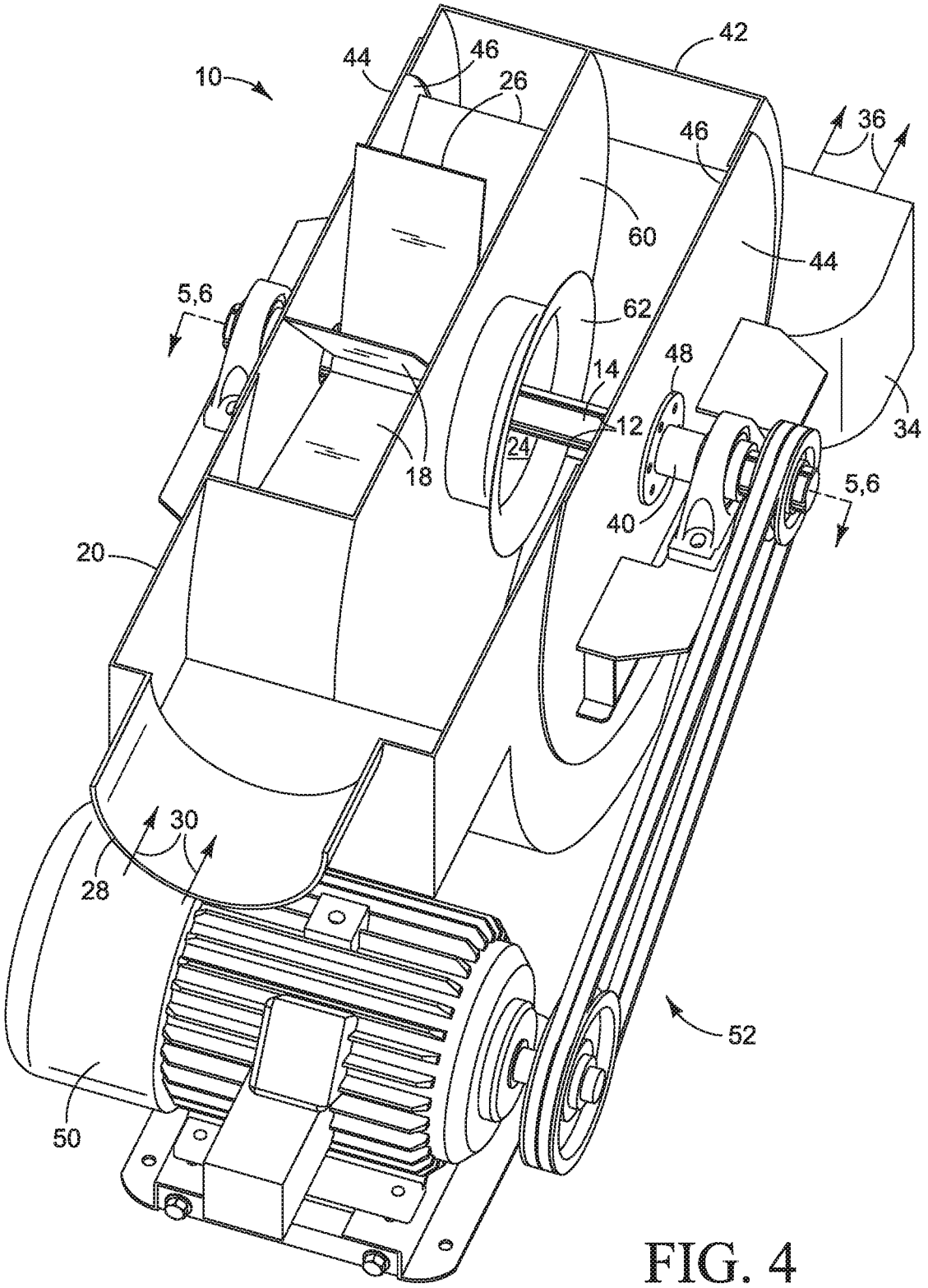
Figure 5:
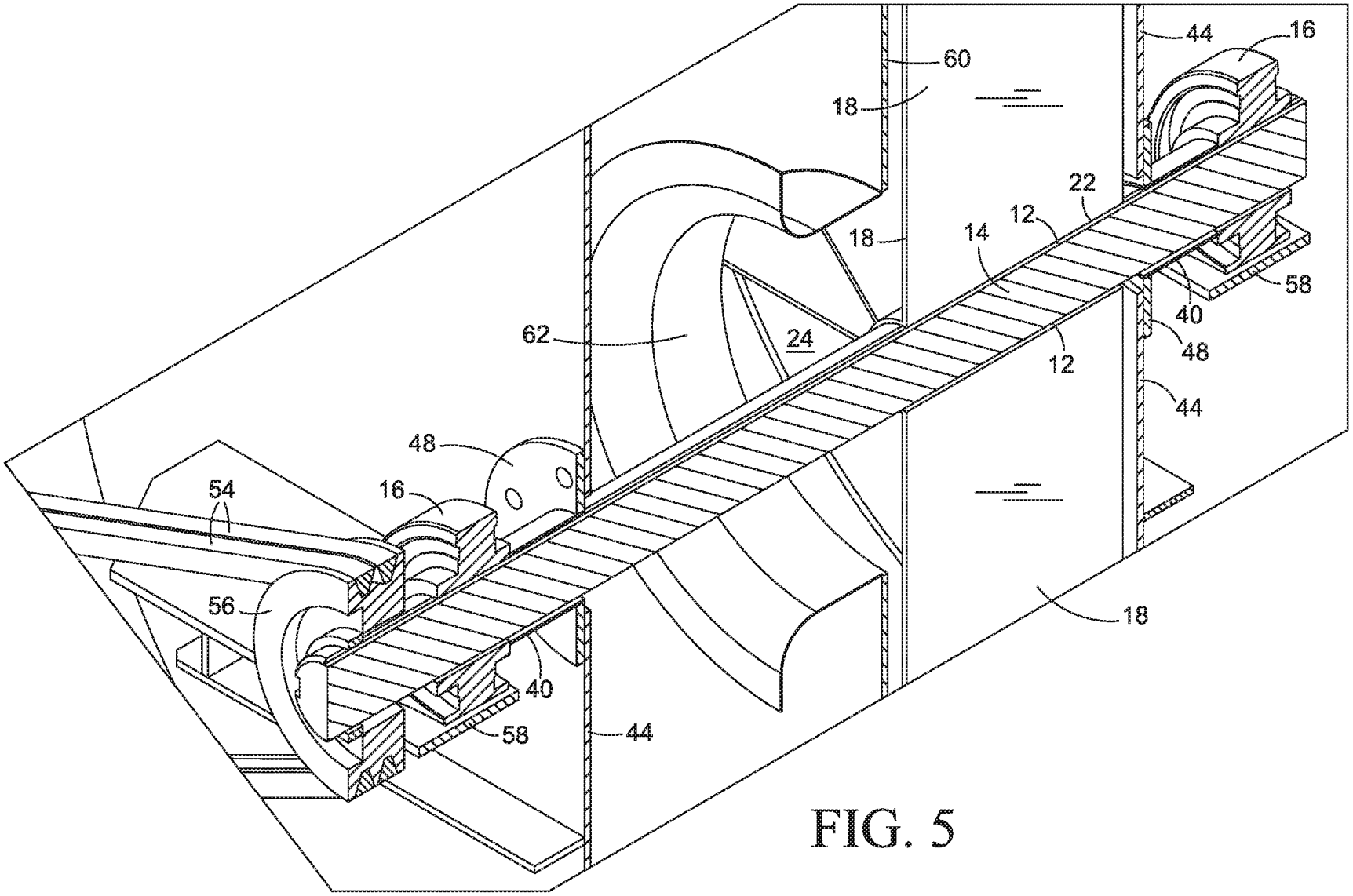
Figure 6:
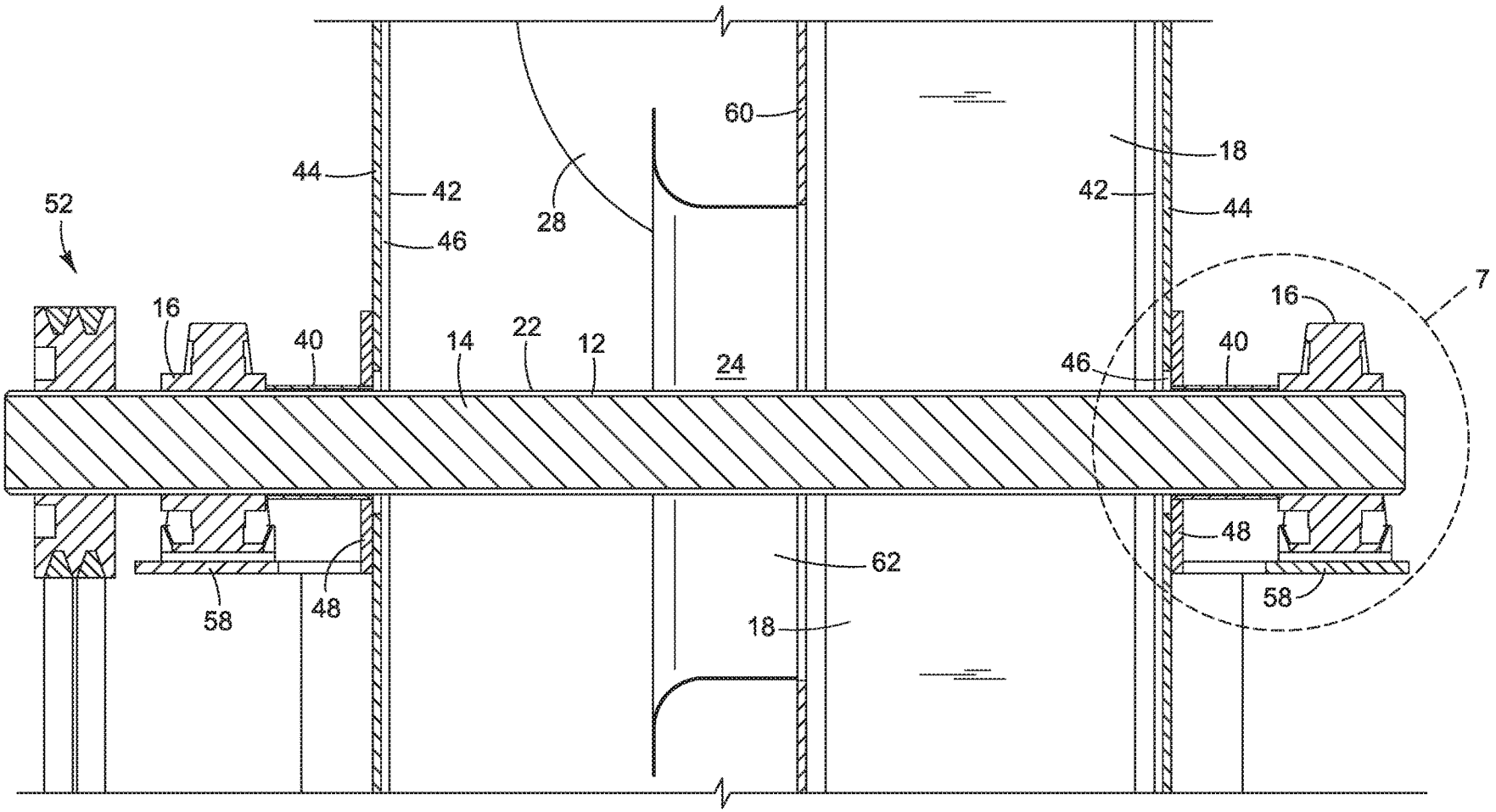
Figure 7:
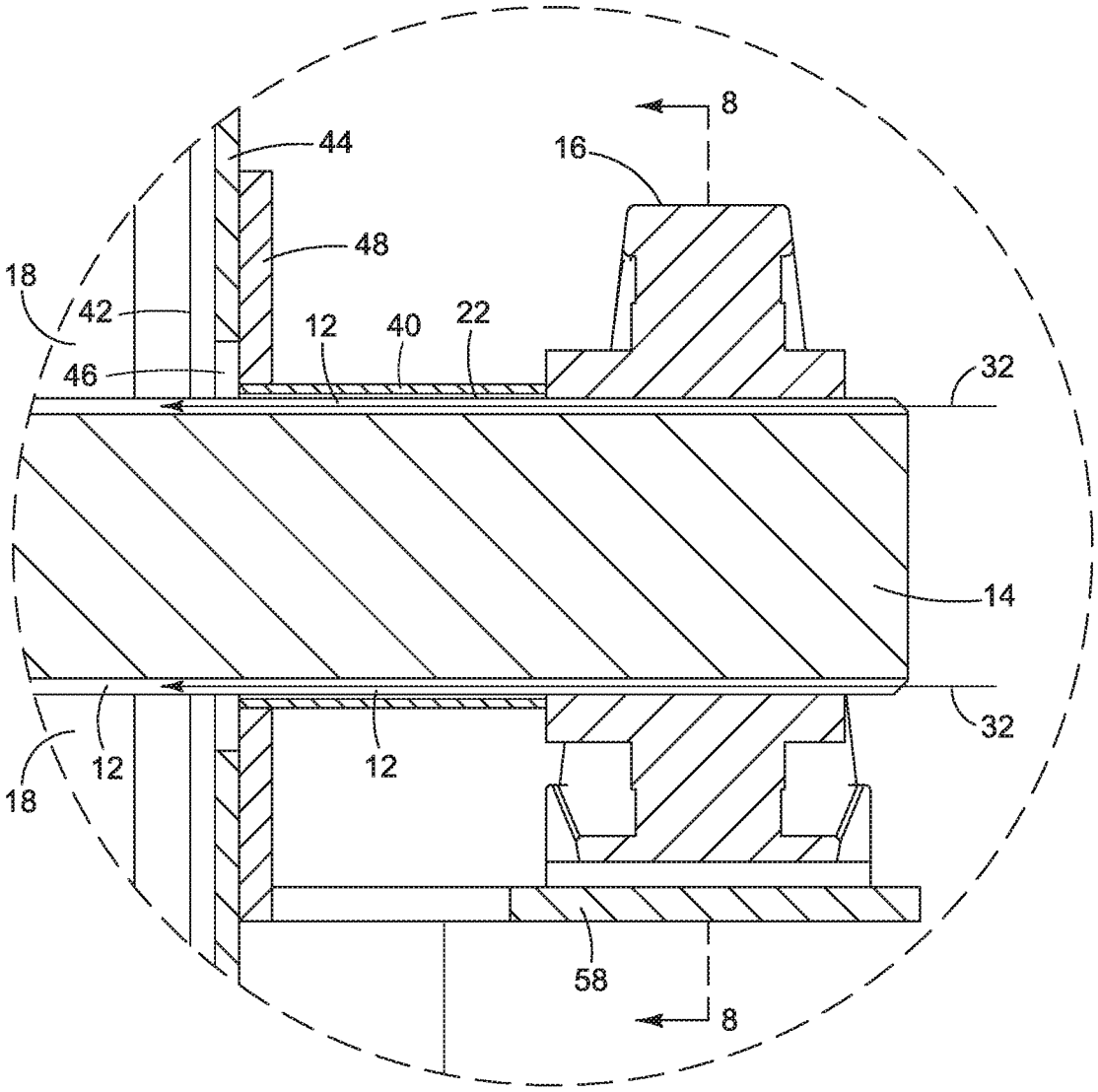
Figure 8:
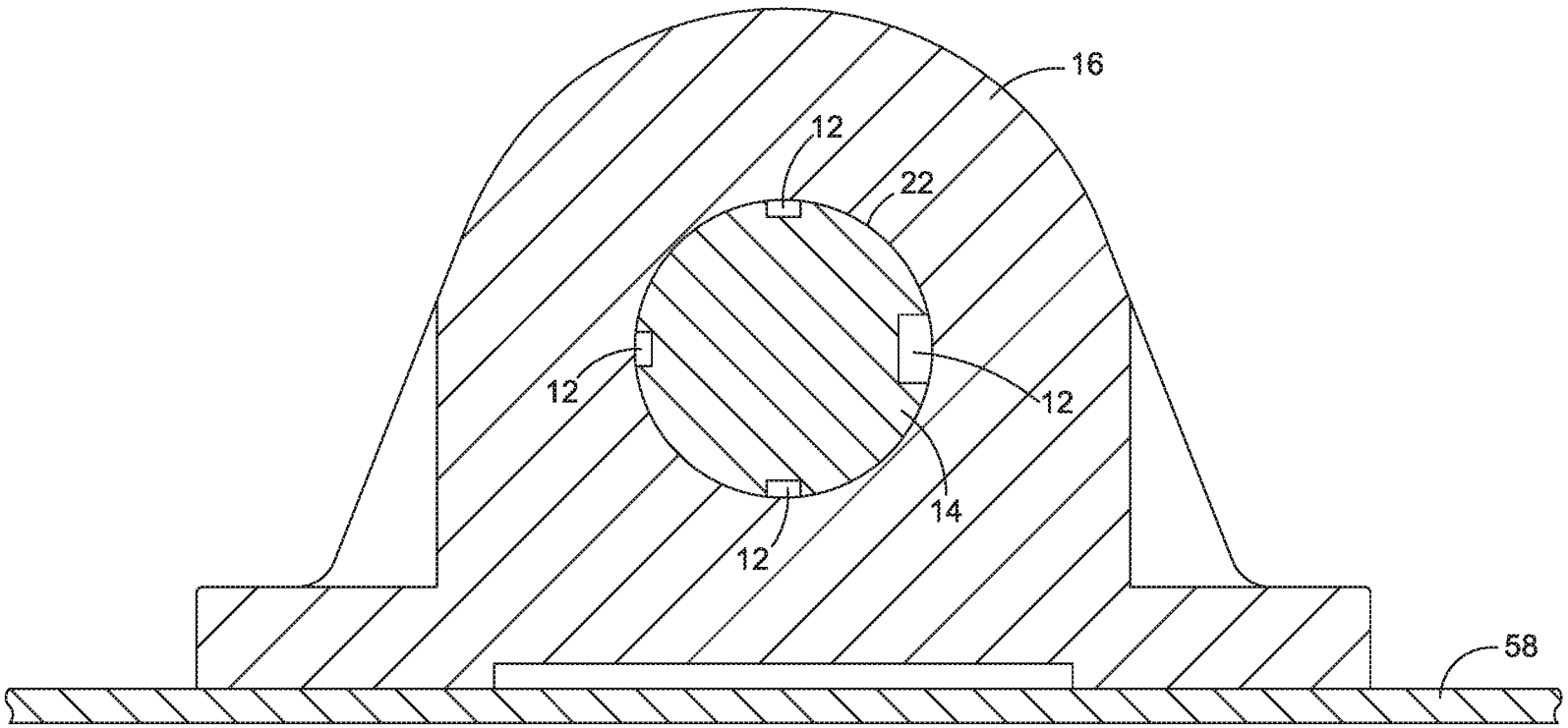

FIGS. 2-8 illustrate another example of a centrifugal fan implementing bearing cooler grooves. FIGS. 2 and 3 are right and left side isometrics of the fan, respectively. FIG. 4 is a section along the line 4-4 in FIG. 2. FIGS. 5 and 6 are isometric and elevation sections, respectively, along the line 5/6-5/6 in FIG. 4. FIG. 7 is a detail from FIG. 6. FIG. 8 is a section along the line 8-8 in FIG. 7.

The same part numbers refer to the same or similar parts throughout the figures. The figures are not necessarily to scale.

DESCRIPTION

Centrifugal fans may be used in hot air dryers for inkjet printing systems to blow large volumes of hot air over the printed substrate. The bearings supporting the fan drive shaft in such high temperature environments can overheat without some type of cooling mechanism to maintain the bearings at an appropriate temperature, particularly when the intake air does not flow over the bearings. One type of bearing cooler uses small fan blades on the drive shaft next to the bearings to circulate air around the bearings—such mini-fans are commonly referred to as "heat slingers." Heat slingers can be noisy, often emitting a high pitch sound.

A new mechanism has been developed to cool the bearings in a centrifugal fan without the noise of a heat slinger. In one example, a groove in the fan drive shaft extends axially along the outer surface of the shaft through the bearing from outside the fan housing to the lower pressure region inside the fan housing. During fan operation, air drawn through the groove into the lower pressure region of the fan cools the bearing. Multiple grooves spaced radially from one another around the outer surface of the shaft may be used to increase the flow of air through the bearing for more cooling. This and other examples of the new cooling mechanism may be implemented in centrifugal fans used in large volume hot air dryers for high speed inkjet printing systems. However, examples are not limited to hot air dryers or inkjet printing but may be implemented in other centrifugal fans and in other operating applications.

These and other examples described below and shown in the figures illustrate but do not limit the scope of the patent, which is defined in the Claims following this Description.

FIG. 1 illustrates one example of a centrifugal fan 10 implementing bearing cooler grooves 12. Referring to FIG. 1, fan 10 includes grooves 12 in a shaft 14 extending through and supported in a bearing 16. Fan blades 18 are mounted to or otherwise operatively connected to shaft 14 inside a housing 20. Each groove 12 extends axially along the outer surface 22 of shaft 14 through bearing 16 and into housing 20. In operation, a motor (not shown) rotates shaft 14 and thus blades 18 to take in air axially to a lower pressure region 24 surrounding shaft 14 inside housing 20, and exhausts air radially from housing 20 at the outer perimeter 26 of blades 18. In the example shown in FIG. 1, air is taken in to housing 20 through an intake duct 28 as indicated by flow arrows 30 and through grooves 12 as indicated by arrows 32. Air is exhausted from housing 20 through an exhaust duct 34 as indicated by flow arrows 36.

In this example, housing 20 encloses blades 18 and that part of shaft 14 connected to blades 18. Grooves 12 extend axially through bearing 16 from outside housing 20 to inside housing 20. Housing 20 fits closely around shaft 14 to inhibit the flow air into housing 20 along shaft 14 except through grooves 12. Where bearing 16 is outside housing 20 a substantial distance 38, as shown in FIG. 1, fan 10 may also include a sleeve 40 that fits closely around shaft 14 between bearing 16 and housing 20. Sleeve 40 helps maintain a pressure drop that allows a cooling air flow through grooves 12 from outside bearing 16 to lower pressure region 24 inside housing 20. Thus, housing 20 may fit closely around shaft 14 indirectly through a sleeve 40 as shown in FIG. 1, or directly if the bearing is positioned close to the housing (not shown). A "substantial" distance 38 means a distance too great to maintain a pressure drop sufficient for cooling air flow through grooves 12.

Although the example of FIG. 1 includes multiple grooves 12, it may be possible in some examples to use just one groove 12. Any suitable bearing 16 may be used including, for example, a bushing, journal or roller bearing.

FIGS. 2-8 illustrate another example of a centrifugal fan 10 implementing bearing cooler grooves 12. FIGS. 2 and 3 are right and left side isometrics of fan 10, respectively. FIG. 4 is a section along the line 4-4 in FIG. 2. Hatching is omitted from FIG. 4 due to the thinness of the housing. FIGS. 5 and 6 are isometric and elevation sections, respectively, along the line 5/6-5/6 in FIG. 4. FIG. 7 is a detail from FIG. 6. FIG. 8 is a section along the line 8-8 in FIG. 7.

Referring to FIGS. 2-8, fan 10 includes grooves 12 in a fan drive shaft 14 extending through and supported in bearings 16. Fan blades 18 are mounted to or otherwise operatively connected to shaft 14 inside a housing 20. Housing 20 encloses blades 18 and that part of shaft 14 connected to blades 18. In this example, bearings 16 are located opposite one another outside housing 20. Grooves 12 extend axially through each bearing 16 from outside housing 20 to inside housing 20. In this example, each groove 12 extends axially along the outer surface 22 of shaft 14 continuously for the full length of the shaft. Also in this example, as best seen in FIG. 8, four axial grooves 12 are evenly spaced radially around the outer surface 22 of shaft 14. Other suitable groove configurations are possible. For example, discrete grooves at each end of shaft 14 to cool a respective bearing 16 could be used instead of the full length grooves 12 shown in FIGS. 2-8. For another example, to enable the desired air flow more or fewer grooves 12 could be used and/or differently shaped and/or spaced from those shown in the FIGS. 2-8.

In this example, as best seen in FIGS. 2-4, housing 20 includes a body 42 and a plate 44 on each side of body 42 covering an opening 46 to the interior of housing 20. A sleeve 40 fits closely around shaft 14 between each bearing 16 and a respective side plate 44 to maintain a pressure drop that allows a cooling air flow through grooves 12 from outside bearings 16 to a lower pressure region 24 inside housing 20. Sleeves 40 are secured in position along and around shaft 14, for example with flanges 48 affixed to side plates 44. In this example, as best seen in FIG. 7, the inside diameter of each sleeve 40 is slightly larger than the outside diameter of shaft 14 to reduce friction between the rotating shaft 14 and the stationary sleeve 40. "Slightly" larger means large enough to reduce friction but not so large as to inhibit the flow of air through grooves 12.

Fan drive shaft 14 is operatively connected to a motor 50 through a drive train 52 which, in this example, includes belts 54 and pulleys 56. Bearings 16 and motor 50 are mounted to a frame 58. One groove 12 may be used as a keyway, the larger groove in FIG. 8, if desired to receive a mating key or keys to operatively connect pulleys 56 and/or blades 18 to shaft 14.

In operation, motor 50 rotates shaft 14 and thus blades 18 through drive train 52 to take in air axially to a lower pressure region 24 surrounding shaft 14 inside housing 20 and exhausts air radially from housing 20 at the outer perimeter 26 of blades 18. Air is taken in to housing 20 through an intake duct 28 as indicated by flow arrows 30 in FIGS. 2-4, and through grooves 12 as indicated by flow arrows 32 in FIG. 7. Air is exhausted from housing 20 through an exhaust duct 34 as indicated by flow arrows 36 in FIG. 2-4. In this example, as shown in FIGS. 4-6, a center panel 60 in housing 20 separates blades 18 and exhaust duct 34 from intake duct 26 except at a central region 62 where air may pass from intake duct 26 into blades 18.

Although the example of FIGS. 2-8 includes multiple grooves 12, it may be possible in some examples to use just one groove 12. Any suitable bearing 16 may be used including, for example, a bushing, journal or roller bearing.

The examples shown in the figures and described above illustrate but do not limit the patent, which is defined in the following Claims.

"A" and "an" used in the claims means one or more.

The invention claimed is:

1. A centrifugal fan, comprising:

a bearing;

a shaft rotatably supported by the bearing;

fan blades operatively connected to and rotatable with the shaft to take in air axially and to exhaust air radially;

a housing enclosing the fan blades and a part of the shaft; and a groove in the shaft extending axially along an outer surface of the shaft through the bearing from outside the housing to inside the housing.

2. The fan of claim 1, wherein the groove comprises multiple grooves each extending axially along the outer surface of the shaft through the bearing and spaced radially from one another around the shaft.

3. The fan of claim 1, further comprising:

an intake duct from outside the housing to a region surrounding the shaft inside the housing; and an exhaust duct from an outer perimeter of the blades inside the housing to outside the housing.

4. The fan of claim 3, wherein the bearing is outside the housing and the fan comprises a sleeve around the shaft between the bearing and the housing.

5. The fan of claim 1, wherein an intake duct is located away from the bearing so that air moving into or through the intake duct does not pass over the bearing.

6. The fan of claim 1, wherein:

the bearing comprises multiple bearings;

the shaft is rotatably supported by the bearings; and the groove extends axially through the bearings.

7. A centrifugal fan, comprising:

a first bearing;

a second bearing;

a shaft rotatably supported by the bearings;

fan blades operatively connected to and rotatable with the shaft to take in air axially and to exhaust air radially;

a housing enclosing the blades and a part of the shaft, the bearings located opposite one another across the housing;

multiple grooves in the shaft each extending axially along an outer surface of the shaft and spaced radially apart from one another around the shaft, each groove extending through the first bearing from outside the housing to inside the housing and through the second bearing from outside the housing to inside the housing;

an intake duct from outside the housing to a region surrounding the shaft inside the housing; and an exhaust duct from an outer perimeter the blades inside the housing to outside the housing.

8. The fan of claim 7, wherein each bearing is outside the housing and the fan comprises a first sleeve around the shaft between the first bearing and the housing and a second sleeve around the shaft between the second bearing and the housing.

9. The fan of claim 8, wherein the intake duct is located away from the bearing so that air moving into or through the intake duct does not pass over the bearing.

10. The fan of claim 8, comprising:

a frame supporting the bearings; and a motor operatively connected to the shaft.

11. A centrifugal fan, comprising:

a bearing;

a shaft rotatably supported by the bearing;

fan blades operatively connected to and rotatable with the shaft to take in air axially to a lower pressure region and to exhaust air radially at an outer perimeter of the blades;

a housing enclosing the fan blades and a part of the shaft;

a groove in the shaft extending axially along an outer surface of the shaft through the bearing to the lower pressure region, wherein the groove comprises multiple grooves each extending axially along the outer surface of the shaft through the bearing to the lower pressure region and spaced radially from one another around the shaft;

an intake duct from outside the housing to the lower pressure region inside the housing, the intake duct being away from the bearing so that air moving into or through the intake does not pass over the bearing; and an exhaust duct from the outer perimeter of the blades inside the housing to outside the housing.

12. The fan of claim 11, wherein the bearing is outside the housing and the fan comprises a sleeve around the shaft between the bearing and the housing.

* * * * *